United States Patent [19]

Kubik

[11] Patent Number: 4,738,101

[45] Date of Patent: Apr. 19, 1988

[54] FLUID SYSTEM HAVING A HYDRAULIC COUNTERBALANCE SYSTEM

[76] Inventor: Philip A. Kubik, 1527 Lochridge, Bloomfield Hills, Mich. 48013

[21] Appl. No.: 858,885

[22] Filed: Apr. 24, 1986

Related U.S. Application Data

[63] Continuation of Ser. No. 786,835, Oct. 11, 1985, abandoned, which is a continuation of Ser. No. 427,426, Sep. 29, 1982, abandoned.

[51] Int. Cl.[4] ..... F15B 1/02

[52] U.S. Cl. ..... 60/413

[58] Field of Search ..... 60/372, 413, 414, 415; 91/5

[56] References Cited

U.S. PATENT DOCUMENTS

| | | | |
|---|---|---|---|
| 2,605,612 | 8/1952 | Mason | 60/372 |
| 2,651,914 | 9/1953 | Joy | 60/372 |
| 3,083,533 | 4/1963 | Schenkelberger | 60/415 |
| 3,203,165 | 8/1965 | Parr | 60/415 |
| 3,744,375 | 7/1973 | Kubik | 91/411 A |
| 3,779,135 | 12/1973 | Sugimura | 60/413 |
| 3,782,117 | 1/1974 | James | 60/372 |
| 3,942,323 | 3/1976 | Maillet | 60/413 |
| 3,946,559 | 3/1976 | Stevenson | 60/413 |
| 3,964,260 | 6/1976 | Williams et al. | 60/413 |
| 3,971,215 | 7/1976 | Baron et al. | 60/413 |
| 3,994,325 | 11/1976 | Cryder et al. | 60/413 |
| 4,202,174 | 5/1980 | Grigorenko et al. | 60/413 |
| 4,211,078 | 7/1980 | Bass | 60/413 |
| 4,462,759 | 7/1984 | McGeehee | 60/372 |

*Primary Examiner*—Charles T. Jordan
*Assistant Examiner*—Richard L. Klein
*Attorney, Agent, or Firm*—Basile and Hanlon

[57] ABSTRACT

A fluid system is disclosed as having a variable displacement fluid pump connected in a closed-loop circuit to a multi-pressure chamber fluid cylinder. The effective pressure responsive areas of two of the pressure chambers are equal such that when fluid at a selected rate of flow and at a predetermined pressure is communicated to one of the chambers, a force of a predetermined magnitude is generated to cause contraction of the fluid cylinder at a predetermined rate. Similarly, when fluid at the same rate and flow is communicated to the other pressure chamber, a force of the same predetermined magnitude is generated to expand the fluid cylinder. A directional control valve is disposed in the closed circuit between the inlet and outlet of the fluid pump so as to selectively direct fluid to either of the pressure chambers to selectively expand or contract the fluid cylinder. The fluid system further comprises an accumulator and a second directional control valve means that is adapted to communicate a third pressure chamber of the fluid cylinder to the accumulator. The accumulator functions to maintain the pressure in the third fluid chamber to exert a force on the fluid cylinder balancing a selected load that the cylinder may be carrying during the expansion and contraction stages of the cylinder.

8 Claims, 1 Drawing Sheet

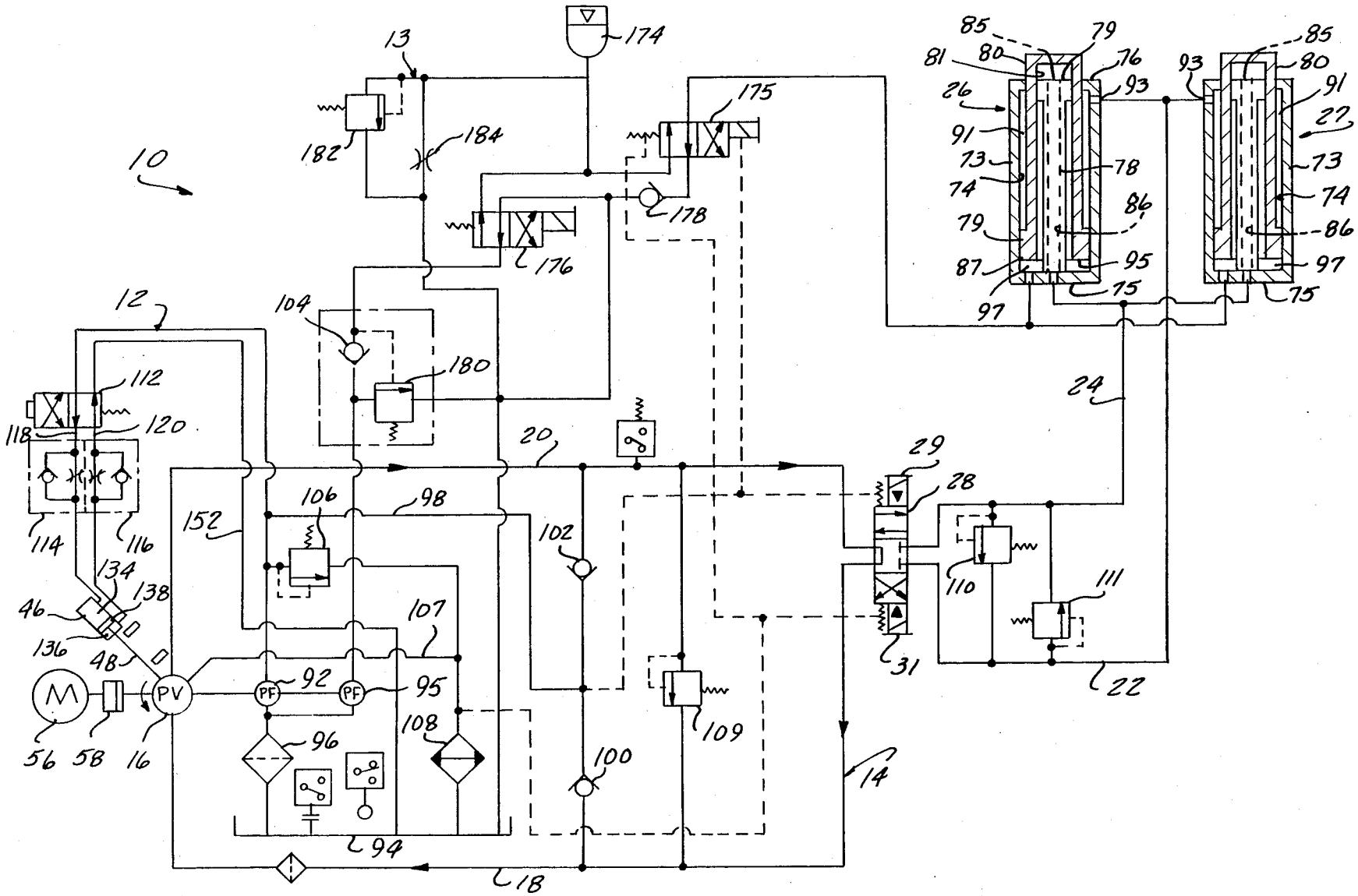
10
12
13
14
16
18
20
22
24
26
27
28
29
31
46
48
56
58
73
74
75
76
78
79
80
81
85
86
87
91
92
93
94
95
96
97
98
100
102
104
106
107
108
109
110
111
112
114
116
118
120
134
136
138
152
174
175
176
178
180
182
184
PF
PV

FLUID SYSTEM HAVING A HYDRAULIC COUNTERBALANCE SYSTEM

This application is a continuation of application Ser. No. 786,835, filed Oct. 11, 1985, which is a continuation of application Ser. No. 427,426, filed Sept. 29, 1982, now both abandoned.

BACKGROUND OF THE INVENTION

I. Field of the Invention

The present invention relates to fluid systems for controlling the movement of a fluid cylinder and, in particular, the present invention relates to a closed-loop, hydrostatic system in which the output of a pump is selectively directed to a fluid cylinder to expand and retract the same while a separate pressure chamber associated with the cylinder is communicated to an accumulator that functions to generate a force that counterbalances the load carried by the cylinder throughout the expansion and retraction stages of the cylinder.

II. Description of the Prior Art

Heretofore numerous fluid systems have been employed for controlling the rate of movement of hydraulic motors and, in particular, systems which have single-rod pistons that have pressure responsive surfaces of equal areas. Thus, the force available for extension and retraction is substantially the same. An example of such a cylinder and a system for operating the cylinder is disclosed in my U.S. Pat. No. 3,744,375 issued July 10, 1973. An application in which such a system might be employed is a lift system as in the raising and lowering of substantial automation equipment. It has been known in the past to provide a separate hydraulic and/or mechanical counterbalance for the press so that the cylinders that are raising and lowering the equipment provide only the force of lift whereas the weight of the equipment is carried by some type of counterbalance system. Systems that may be employed to counterbalance a load are disclosed in U.S. Pat. Nos. 3,942,323, 3,946,559 and 4,202,174. Each of these systems differs from the present invention in that they employ a separate system for the counterbalance function as opposed to the unique and unitary system disclosed in this present application.

It would therefore be desirable to provide a fluid system that has a multi-pressure chamber fluid cylinder wherein one of the pressure chambers is in communication selectively with an accumulator to provide a counterbalance of the load that the cylinder is displacing.

III. Prior Art Statement

In the opinion of applicant and applicant's attorneys the aforementioned prior art represents the most relevant prior art of which applicant and applicant's attorneys are aware.

SUMMARY OF THE INVENTION

The present invention, which will be described subsequently in greater detail, comprises a fluid system having a closed-loop, fluid circuit for selectively connecting the inlet and outlet of a fluid pump to the inlet and outlet of a fluid cylinder. The fluid cylinder is of the multi-pressure chamber type having one chamber adapted to expand the fluid cylinder when communicated to fluid pressure and a second chamber adapted to retract the fluid cylinder when in communication with fluid pressure. A third chamber is selectively communicated to a fluid accumulator when pressure fluid is being communicated to either the first or second pressure chambers such that pressure in the third fluid chamber is maintained at some predetermined level for balancing the load carried by the fluid cylinder throughout both expansion and retraction of the fluid cylinder.

It is therefore an object of the present invention to provide a fluid cylinder that has an integral accumulator/counterbalance system for balancing the load carried by the fluid cylinder during its retraction and expansion stages.

Other objects, advantages and applications of the present invention will become apparent to those skilled in the art of fluid systems when the accompanying description of one example of the best mode contemplated for practicing the invention is read in conjunction with the accompanying drawing.

BRIEF DESCRIPTION OF THE DRAWING

The description herein makes reference to the accompanying drawing in which the sole FIGURE represents the schematic illustration of the present invention in the form of a fluid system and a pair of single-rod fluid cylinders.

DESCRIPTION OF THE PREFERRED EMBODIMENT

Referring now to the drawing wherein there is illustrated one example of the present invention in the form of a fluid system generally indicated by the numeral 10. The system 10 is comprised of three sub-circuits, the first being a control circuit 12, the second being an accumulator circuit 13 and the third being a main circuit 14.

The main circuit 14 is described in much greater detail in the aforementioned U.S. Pat. No. 3,744,375 and said patent is incorporated herein by reference. The main circuit 14 comprises a variable displacement pump 16 connected in a closed-loop fashion by conduits 18, 20, 22 and 24 to a pair of main fluid cylinders 26 and 27. The cylinders 26 and 27 are identical in construction and function and therefore the subsequent description of the cylinder 26 shall be applicable to the cylinder 27 and common elements will be described by the same numerals. Incorporated in the main circuit 14 is a conventional directional control valve 28 having solenoids 29 and 31 which operate the directional control valve in the conventional manner. Specifically, the control valve 28 is adapted to connect the conduits 18 and 20 selectively to the conduits 22 and 24 or to be positioned as shown tandem-center so as to allow communication between the conduits 18 and 20 and prevent communication between the conduits 22 and 24. The pump 16 is of the well-known axial piston type and is described in much greater detail in the aforementioned U.S. Pat. No. 3,744,375. The pump 16 is operatively coupled to a secondary fluid cylinder 46 by a connecting arm 48 for movement from a neutral, minimum displacement position to a maximum or full-flow position. A prime mover, such as an electric motor schematically illustrated at 56, is mechanically connected through a suitable coupling device 58 to the drive shaft of the pump 16. As is conventional in pumps of the type illustrated, the inlet and outlet ports thereof, respectively, communicate with the conduits 20 and 18.

Each of the main fluid cylinders 26 and 27 comprises a first outer tubular member 73 provided with an internal bore 74. The tubular member 73 has a closed end 75, while the opposite end 76 is provided with a bore substantially aligned with the longitudinal axis of the internal bore 74. A projecting cylindrical member 78, disposed within the tubular member bore 74 along the longitudinal axis thereof, has one end integrally attached to the closed end 75 of the tubular member 73, while the projecting end of the member 78 has a radially enlarged section forming a piston 79. A piston rod 80, in the form of an inner tubular member radially inwardly spaced from and telescopically received by the outer tubular member 73, has an outer surface of a diameter corresponding to the diameter of the bore in the end 76 and is adapted to be slidably and sealingly mounted therethrough. The inner tubular member or piston rod 80 has an internal bore 81 adapted to slidably and sealingly surround the piston 79 of the projecting cylindrical member 78. The internal bore 81 of the piston rod 80 has a blind end which in conjunction with the outer face of the piston 79 defines an expansible pressure chamber 85 that is in constant fluid communication with the conduit 24 by means of a longitudinal bore 86 extending through the member 78.

The inner end of the piston rod 80 has a radially enlarged portion forming a second piston 87, the outer periphery of which sealingly and slidably engages the internal bore 74 of the outer tubular member 73. The annular space defined by the outer periphery of the piston rod 80, the radially outwardly spaced inner surface of the outer tubular member 73 and the opposing annular areas on the piston 87 and the tubular member end 76, respectively, form a second expansible pressure chamber 91 which is in constant fluid communication with the conduit 22 through the connection port 93.

The effective pressure responsive area of the surface of piston 87 exposed to the pressure of the fluid in the expansible chamber 91 is substantially equal to the effective pressure responsive area of the piston 79 exposed to the pressure in the expansible pressure chamber 85. Thus, when fluid is admitted to the expansible pressure chamber 85 from the conduit 24 via longitudinal bore 86 at a predetermined pressure, a force of a predetermined magnitude is generated against the piston 79 and the blind end of the piston rod 80, resulting in the fluid cylinder 26 expanding at a certain rate; that is, the piston rod 80 will move upwardly as viewed in the figure at a speed which is dependent upon the rate of flow communicated to the expansible pressure chamber 85 from the pump 16. When fluid at the same rate of flow and at the same predetermined pressure is supplied to the expansible pressure chamber 91 via the conduit 22, a force of the same predetermined magnitude will be generated on the opposing annular surfaces that will cause the fluid cylinder to be contracted; that is, the piston rod 80 will move downwardly into the tubular member 73 at the same rate as that obtained during the expansion of the fluid cylinder 26. The rate of movement, of course, can be different for expansion and retraction depending upon the output of the fluid pump 16.

The opposite face 95 of the piston 87 and the end wall 75 of the tubular member 73 forms a third expansible pressure chamber 97 which is adapted to be connected to an accumulator 174 through the solenoid-actuated, directional control valve 175. The accumulator 174 is adapted to communicate fluid pressure to the third pressure chamber 97 as the fluid cylinder 26 is being expanded due to pressure being exerted in the pressure chamber 85 via conduit 24. When pressure fluid is directed through conduit 22 to the pressure chamber 91 to cause expansion of pressure chamber 91 and thus contraction of the pressure chamber 97, pressure fluid is communicated via directional control valve 175 to the accumulator 174, as will be described in greater detail hereinafter. The accumulator circuit 13 further comprises an accumulator overload relief valve 182 and an accumulator bleed-off valve in parallel therewith and identified by the numeral 184.

The fluid system 10 and, in particular, the main circuit 14 is further provided with a pair of positive, fixed-displacement replenishing pumps 92 and 95. These pumps may be gear pumps and are driven by the prime mover 56 through a suitable drive shaft arrangement. The replenishing pump 92 is in communication with a reservoir 94 through a supply conduit and filter 96 for supplying the replenishing fluid to the main circuit 14 through a delivery conduit 98. Spring-biased check valves 100 and 102 are in communication with the delivery conduit 98 and the closed-loop, main circuit conduits 18 and 20 respectively for supplying replenishing fluid to whichever of the conduits 18 and 20 is the low-pressure side of the closed-loop main circuit 14 through one of the check valves, while pressure on the high-pressure side of the main circuit maintains the other check valve closed. The fixed displacement pump 95 functions to communicate fluid via check valve 104 and the directional control valve 176 to maintain the accumulator 174 at a pressure determined by unloading valve 180. A conventional spring-biased, high-pressure relief valve 106 is provided for the replenishing pump 92 for relieving excessive fluid pressure in the replenishing delivery circuit 98. The outlet of the relief valve 106 is connected to the reservoir 94 by suitable conduit and, in this case, through the conduit 107 which directs fluid do the reservoir 94 through oil cooler 108. The main circuit 14 also includes a main circuit relief valve 109.

Downstream of the directional control valve 28, conduits 22 and 24 are respectively connected to the inlets of high-pressure relief valves 110 and 111 which at a predetermined pressure, for example, 3000 psi, will exhaust the pressure fluid from one of the conduits to the other conduit so as to prevent damage to the main circuit 14 in the event of overpressurization.

Referring now to the control circuit 12 for a description of the method of controlling the displacement of the fluid pump 16, there is illustrated a directional control valve 112 adapted to selectively connect fluid from the replenishing pump 92 to either of a pair of feed control valves 114 and 116 via conduits 118 and 120, respectively. The feed control valves 114 and 116 are, in turn, respectively, connected to the ports of the secondary cylinder 46. The secondary fluid cylinder 46 comprises a tubular housing having an interior bore divided into two pressure chambers 134 and 136 by means of a reciprocally mounted piston 138 which, in turn, carries the connecting rod 48 that extends externally of the cylinder 46 and is operatively coupled to the pump 16.

The feed control valves 114 and 116 may be of the conventional type and have restricted passages which are adjustable such that each of the feed control valves may be preset to vary the flow rate therethrough over a wide range. Each of the feed control valves 114 and 116 includes a check valve which permits fluid to bypass the restricted passages in one direction only. Thus, when the directional control valve 112 is in the position indicated, fluid flow is directed from the fixed displacement pump 92 through the conduit 120 to the feed control valve 116, bypassing the restricted passage while flowing through its associated check valve, and is then directed to the pressure chamber 136 on one side of the cylinder piston 138 to move the same leftwardly to displace the fluid pump 16 towards its full-flow position. Fluid on the opposite side of the piston cylinder 138 within the pressure chamber 124 will be exhausted through conduit 126 to the feed control valve 114 at a rate of flow which is determined by the setting of its associated restricted passage. Fluid returns to the reservoir 94 via directional control valve 112 and a return conduit 152. When the directional control valve 112 is reversed so as to direct fluid flow through the check valve of the feed control valve 114 to the pressure chamber 134 to move the piston 138 rightwardly, fluid is exhausted through the restricted passage of the feed control valve 116 which, in turn, controls the rate of movement of the piston 138. As the piston 138 moves rightwardly, the connecting arm 48 is moved toward the minimum displacement position 52.

The type of feed control illustrated is known as a meter-out control; that is, the rate of movement of the piston 138 within the secondary cylinder 46 is determined by the rate of the fluid being exhausted from the pressure chamber 134 or 136 which, in turn, is controlled by the feed control valve 114 and 116. A detailed description of the feed control valves 114 and 116 is not necessary as such feed control valves per se are well known and commercially available.

It can be seen that the rate of change in the displacement of the fluid pump 16 is controlled by the feed control valves 114 and 116 and, thus, if the restricted passages of the feed control valves are set to permit a high rate of flow to pass therethrough, the cylinder piston 138 will be displaced rapidly, causing a rapid change in the displacement of the fluid pump 16 which, in turn, when communicated to the main fluid cylinder 26, will generate a rapid acceleration and/or deceleration in the expansion and/or contraction of the fluid cylinder 26.

In operation, when it is desired to direct fluid from the fluid pump 16 through the conduit 20, the directional control valve 28 and the conduit 24 to accelerate the piston rod 80 of the main cylinder 26 (27) upwardly at a rapid rate, that is, to expand the fluid cylinder 26, the directional control valve 112 of the control circuit 12 is actuated by a suitable switching means (not shown) so as to direct fluid from the fixed pump 92 into the pressure chamber 136 of the fluid cylinder 46 to drive the piston therein leftwardly, as viewed in the drawing, to stroke the fluid pump 16 to the maximum displacement or some other intermediate displacement. Fluid from the secondary cylinder chamber 134 is exhausted through the adjustable restricted passage of the feed control valve 114 which is set to permit a high rate of fluid flow therethrough, thus permitting a rapid stroking of the pump 16 which, in turn, will deliver a maximum amount of fluid into the conduit 20. The directional control valves 112 and 28 in the control and main circuits, respectively, are simultaneously actuated so that as the secondary cylinder is actuated, fluid from the variable displacement pump 16 will be directed via conduit 24 and bore 86 to the main fluid cylinder chamber 85 to expand the same and accelerate the piston rod 80 rapidly upwardly as viewed in the drawing.

When the directional control valve solenoid 29 of the valve 28 is activated to communicate fluid to the fluid cylinder chamber 85 via conduit 24, the solenoid valve 175 is simultaneously activated while solenoid valve 176 is deactivated. Thus, while fluid is flowing via conduit 24 to the pressure chamber 85 to expand the cylinder 26, a predetermined pressure rate of charge is maintained in the chamber 97 by means of the accumulator 174 to counterbalance any selected load that is carried by the cylinders 26 and 27, for example, the weight of the aforementioned automation equipment being operated by the cylinders 26 and 27. During the expansion of the main fluid cylinder 26, fluid flows from the accumulator 174 through the directional control valve 175 and into the pressure chamber 97.

When the piston rod 80 is in its fully extended position, the load of the mechanism is counterbalanced by pressure in the third chamber 97. Moving the directional control valve 28 to a tandem-center or no-flow condition will prevent fluid flow either to or from the cylinder chambers 85 and 91, quickly stopping the movement of the piston rod 80 and maintaining the same at the desired position. When it is desired to lower the fluid cylinder 26, that is, to contract the same, the directional control valve solenoid 31 is actuated so as to communicate pressure fluid to the conduit 22; that is, fluid under pressure from the pump 16 is communicated to the pressure chamber 91 via conduits 20 and 22. Thus, the piston rod 80 will be shifted downward towards a retracted position. Simultaneously with the activation of solenoid 31 of four-way control valve 28, the flow control valve 175 is activated so that fluid in the chamber 97 is communicated to the accumulator 174. When the cylinder is in the fully retracted position illustrated, directional control valves 28 and 175 are both deactivated; that is, directional control valve 28 is moved to the tandem position while valve 175 is moved to the position illustrated, communicating the chamber 97 with the reservoir 94 through check valve 178. The fluid under pressure for counterbalancing the unit is preserved within the accumulator 174 and the accumulator is communicated to the unloading valve 180 and check valve 104 via directional control valve 176 to provide for replenishing of the accumulator 174.

It can thus be seen that the present invention has provided a new and improved counterbalance system for a closed-loop hydraulic drive having a single-rod cylinder.

While the embodiment of the present invention as disclosed herein constitutes a preferred form, it should be understood by those skilled in the art that other forms may be had, all coming within the spirit of the invention and the scope of the appended claims.

What is claimed is as follows:

1. A fluid system comprising:

a fluid pump for generating a first source of fluid pressure;

a fluid cylinder for carrying a load, having a plurality of chambers, wherein:

a first chamber expands the fluid cylinder when communicated to the fluid pump;

a second chamber contracts the fluid cylinder when communicated to the fluid pump, the effective pressure responsive areas of the first and second chambers being equal; and a third chamber;

conduit means for selectively connecting the first and second chamber to said fluid pump in a closed-loop fashion;

a charged fluid accumulator adapted to communicate fluid pressure to said third chamber when either said first or said second chamber receives fluid pressure from the fluid pump;

means for electro-mechanically and selectively communicating the accumulator to said third chamber to connect pressure fluid to said third chamber so that the load carried by the fluid cylinder is counterbalanced throughout the expansion and contraction of the fluid cylinder;

means for automatically disconnecting the accumulator from said third chamber when the fluid cylinder is at rest in a contracted position;

an open-loop system having fluid means for generating a second source of fluid pressure which is independent of and not communicating with said closed-loop system; and means for communicating said second source of fluid pressure to said accumulator to automatically charge the accumulator when the accumulator is disconnected from said third chamber of said fluid cylinder.

2. A fluid system comprising:

a first pressure energy translating device for providing a first source of fluid pressure, said device having a fluid inlet and a fluid outlet;

fluid cylinder means for displacing a predetermined load and having a first tubular member with at least one end closed;

a piston reciprocally mounted in said first tubular member and forming a first fluid chamber on one side thereof within said first tubular member, said first tubular member being movable in response to an increase in fluid in said first chamber;

a connecting member carried by the other side of said piston and movable therewith;

a second tubular member telescopically received by said first tubular member and radially outwardly spaced therefrom to define a second fluid chamber, said connecting member connecting said piston to said second tubular member;

a fluid actuated member in said second fluid chamber connected to said first tubular member and movable in response to an increase in fluid in said second fluid chamber to produce movement of said fluid actuator member relative to said second tubular member, said second tubular member and said fluid actuated member defining a third fluid chamber;

the effective pressure responsive area of said fluid actuated member exposed to the fluid in said second fluid chamber being equal to the effective pressure responsive area of said one side of said piston exposed to the fluid in said first fluid chamber, said actuated member being operable upon an increase in the fluid in said second fluid chamber to move said first tubular member in a direction toward said piston and contract said first fluid chamber to move said fluid cylinder means to a retracted position while said piston is operable upon an increase in fluid in said first fluid chamber to move said first tubular member in a direction away from said piston and expend said first fluid chamber to move said fluid cylinder means to an extended position;

valve means connecting the inlet and outlet of said first device to said first and second fluid chambers within said fluid cylinder means for selectively directing fluid pressure from said first device to and from said first and second fluid chambers in a closed-loop fashion;

an accumulator;

an open-loop fluid circuit having a second pressure energy translating device for providing a second source of fluid pressure independent of and separate from said first mentioned source of fluid pressure;

an unloading valve;

a second valve means for selectively communicating said unloading valve and said accumulator with said third fluid chamber of said fluid cylinder means;

a third valve means for selectively communicating said accumulator and said valve means with said second source of pressure;

first means for actuating said third valve means when said fluid cylinder means is in said retracted position to communicate said second source of fluid pressure to said accumulator to charge said accumulator to a predetermined pressure;

second means for actuating said second valve means when said fluid cylinder means is in said retracted position to close communication between said accumulator and said third pressure chamber and open communication between said third pressure chamber and said unloading valve;

said first means actuating said third valve means to close communication between said second source of fluid pressure and said accumulator, and said second means actuating said second valve means to connect said accumulator and said third pressure chamber during movement of said fluid cylinder means between said expanded and retracted positions to maintain the pressure in said third fluid chamber at a predetermined value to exert a force on said fluid actuating member for counterbalancing said load throughout the expansion and retraction of said fluid cylinder means; and wherein, when said fluid cylinder means is at rest in said retracted position and said load is not being counterbalanced, said accumulator means is automatically disconnected from said third pressure chamber, and said second source of fluid pressure is automatically connected to said accumulator means to charge said accumulator.

3. The fluid system defined in claim 2 wherein said means for selectively communicating said inlet and outlet of said device to said first chamber comprises a passage extending through said connecting member and said piston and opening into said first chamber.

4. The fluid system defined in claim 2 wherein said fluid pressure energy translating device comprises a fluid pump having means for varying the displacement thereof between a minimum and maximum displacement; pressure responsive means comprising a second fluid cylinder having a piston with a connecting rod extending from one end thereof, said extending end of said connecting rod being operatively coupled to said pump varying means, a separate source of fluid pressure being selectively communicated to opposite sides of said last mentioned fluid cylinder; and flow control valve means disposed between said separate source of fluid pressure and the opposite sides of said second cylinder for controlling the rate of fluid flow to said opposite sides of said second cylinder, whereby the rate of movement of said second cylinder and thus the rate of change in displacement of said fluid pump is selectively controlled.

5. The fluid system defined in claim 4 wherein said fluid system further comprises a fluid feed control valve for controlling the rate of fluid flow from said second source to one side of said second cylinder; a second fluid feed control controlling the rate of fluid flow to the other side of said second cylinder piston; and a directional flow control valve for selectively controlling the flow from said second source of pressure to said feed control valve.

6. The fluid system defined in claim 5 wherein each of said feed control valves is selectively adjustable.

7. The fluid system defined in claim 4 wherein said fluid system further comprises means for adjustably varying the minimum and maximum displacement of said fluid pump at some selected displacement less than the maximum displacement of said pump and at some displacement greater than the minimum displacement of said pump, respectively.

8. The fluid system defined in claim 2 wherein said first mentioned valve means comprises a directional control valve having an inlet and outlet port respectively connected to the outlet and inlet ports of said pressure energy translating device, said directional control valve selectively connecting the outlet of said pressure energy translating device to one of said fluid cylinder chambers while connecting the other of said fluid cylinder chambers to the inlet of said pressure energy translating device, whereby said fluid cylinder may be selectively expanded and retracted in response to fluid flow selectively communicated to the said fluid cylinder chamber.

* * * * *